US010842704B1

(12) United States Patent
Hays et al.

(10) Patent No.: US 10,842,704 B1
(45) Date of Patent: Nov. 24, 2020

(54) SLEEP BOARD SOLUTION

(71) Applicant: HKII Corporation, Vista, CA (US)

(72) Inventors: William Hays, Vista, CA (US); George Kosty, III, Carlsbad, CA (US)

(73) Assignee: HKII Corporation, Vista, CA (US)

( * ) Notice: Subject to any disclaimer, the term of this patent is extended or adjusted under 35 U.S.C. 154(b) by 501 days.

(21) Appl. No.: 15/635,062

(22) Filed: Jun. 27, 2017

Related U.S. Application Data

(60) Provisional application No. 62/355,137, filed on Jun. 27, 2016.

(51) Int. Cl.

| | |
|---|---|
| ***A61H 1/02*** | (2006.01) |
| ***A47C 27/16*** | (2006.01) |
| ***A47C 31/10*** | (2006.01) |
| ***A47C 27/15*** | (2006.01) |
| ***A47C 31/00*** | (2006.01) |

(52) U.S. Cl.
CPC ..... *A61H 1/0218* (2013.01); *A47C 27/15* (2013.01); *A47C 27/16* (2013.01); *A47C 31/007* (2013.01); *A47C 31/105* (2013.01); *A61H 2201/0146* (2013.01); *A61H 2201/1609* (2013.01); *A61H 2201/1614* (2013.01); *A61H 2201/1623* (2013.01); *A61H 2201/1628* (2013.01); *A61H 2203/0456* (2013.01)

(58) Field of Classification Search
CPC ..... A61H 1/0218; A61H 2203/0456; A61H 2201/0146; A61H 2201/1623; A61H 2201/1614; A61H 2201/1609; A61H 2201/1628; A47C 31/007; A47C 27/15; A47C 31/105; A47C 27/16; B29C 44/5627; B68G 7/00; H05F 3/00; Y10T 29/48; Y10T 29/49826; Y10T 29/49863
See application file for complete search history.

(56) References Cited

U.S. PATENT DOCUMENTS 3,939,508 A * 2/1976 Hall ..... A47C 27/15 5/727
4,241,190 A * 12/1980 Lichter ..... C08J 9/35 264/45.4

(Continued)

*Primary Examiner* — Myles A Throop

(57) ABSTRACT

A Sleep Board Solution. The sleep system assembly has five key benefits: First: providing a solid foundation which aligns the hips, shoulders, back and neck naturally while sleeping. Second: providing a completely unique engineered and manufactured multi-layered foam support system that applies a mild constant traction to the spine and back during the sleep cycle stretching the discs and vertebra to enhance blood flow and promote natural healing during the sleep cycle. The third benefit is that it provides maximum sleeping comfort while totally eliminating any discomfort from the "bottoming out" of hips, shoulders, elbows or knees through the multilayered foam against the solid foundation. In adapting the system, an individual's specific needs/issues are first analyzed in order to optimize the system features for that individual. Finally, the system has a unique ESD conductive carbon fiber stripping encasement designed to interface with an Earthing/Grounding system in order to provide additional proven and well established healthful benefits when grounded directly to the Earth's surface during the sleep cycle.

5 Claims, 3 Drawing Sheets

(56) References Cited

U.S. PATENT DOCUMENTS

| | | | | |
|---|---|---|---|---|
| 4,899,407 | A * | 2/1990 | McCue | A47C 21/022 24/72.5 |
| 2009/0139707 | A1* | 6/2009 | Berzin | E21B 33/1208 166/118 |
| 2013/0025065 | A1* | 1/2013 | Chunglo | A47C 27/144 5/691 |
| 2013/0025069 | A1* | 1/2013 | Ruehlmann | A47C 21/046 5/740 |
| 2013/0025070 | A1* | 1/2013 | Ruehlmann | A47C 27/15 5/740 |
| 2015/0320230 | A1* | 11/2015 | Creekmuir | A47C 27/088 5/709 |
| 2016/0214804 | A1* | 7/2016 | Subhedar | A47C 27/15 |
| 2016/0244880 | A1* | 8/2016 | Thompson | H05F 3/00 |

* cited by examiner

SLEEP BOARD SOLUTION

This application is filed within one year of, and claims priority to Provisional Application Ser. No. 62/355,137, filed Jun. 27, 2016.

BACKGROUND OF THE INVENTION

1. Field of the Invention

The present invention is related to a sleeping system. More specifically, it is an apparatus that aligns the user's body such that they sleep comfortably with improved sleep efficiency, relieve or eliminate back pain, correct posture and do not develop pain or injury from poor sleeping habits or an interior bed/mattress.

2. Description of Related Art

Sleeping is the body's natural way of healing and replenishing energy. The average person spends one third of their life sleeping. Improving the quality of sleep time and sleep correcting the body and spine alignment during sleep to a natural position will correct posture issues, and eliminate or drastically reduce back pain caused by sleeping incorrectly during the night (including other associated issues such as pinched nerves). enhances the body's natural healing process, replenishment of the body's energy and benefiting the body's natural immune system which in turn reduces stress and promotes emotional and physical well-being for long lasting overall health.

Equally important during the sleep cycle is the enhancement of the body's natural healing process, replenishment of the body's energy and the strengthening of the body's natural immune system. An uninterrupted quality nights sleep free from pain, restlessness, and awakening will reduce stress and promote emotional and physical well being and improve overall health. The invention is a unique comprehensive sleep system designed to reduce and eliminate lower back pain, correct posture issues, significantly improve the quality of sleep time and enhance the body's natural healing process that can be utilized on a permanent basis for daily sleeping.

SUMMARY OF THE INVENTION

In light of the aforementioned problems associated with the prior devices and methods, it is an object of the present invention to provide a Sleep Board Solution. The purpose of the sleep system has five key benefits: First: to provide a solid foundation which aligns the hips, shoulders, back and neck naturally while sleeping. Second: to provide a completely unique engineered and manufactured multi-layered foam support system that applies a mild constant traction to the spine and back during the sleep cycle stretching the discs and vertebra to enhance blood flow and promote natural healing during the sleep cycle. The third objective is to provide maximum sleeping comfort while totally eliminating any discomfort from the "bottoming out" of hips, shoulders, elbows or knees through the multilayered foam against the solid foundation. A fourth objective is to analyze an individual's specific needs/issues to optimize the system features for each individual. Finally, the system is provided with a unique ESD conductive carbon fiber stripping encasement designed to interface with an Earthing/Grounding system in order to provide additional proven and well established healthful benefits when grounded directly to the Earth's surface during the sleep cycle.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

Figure 1:
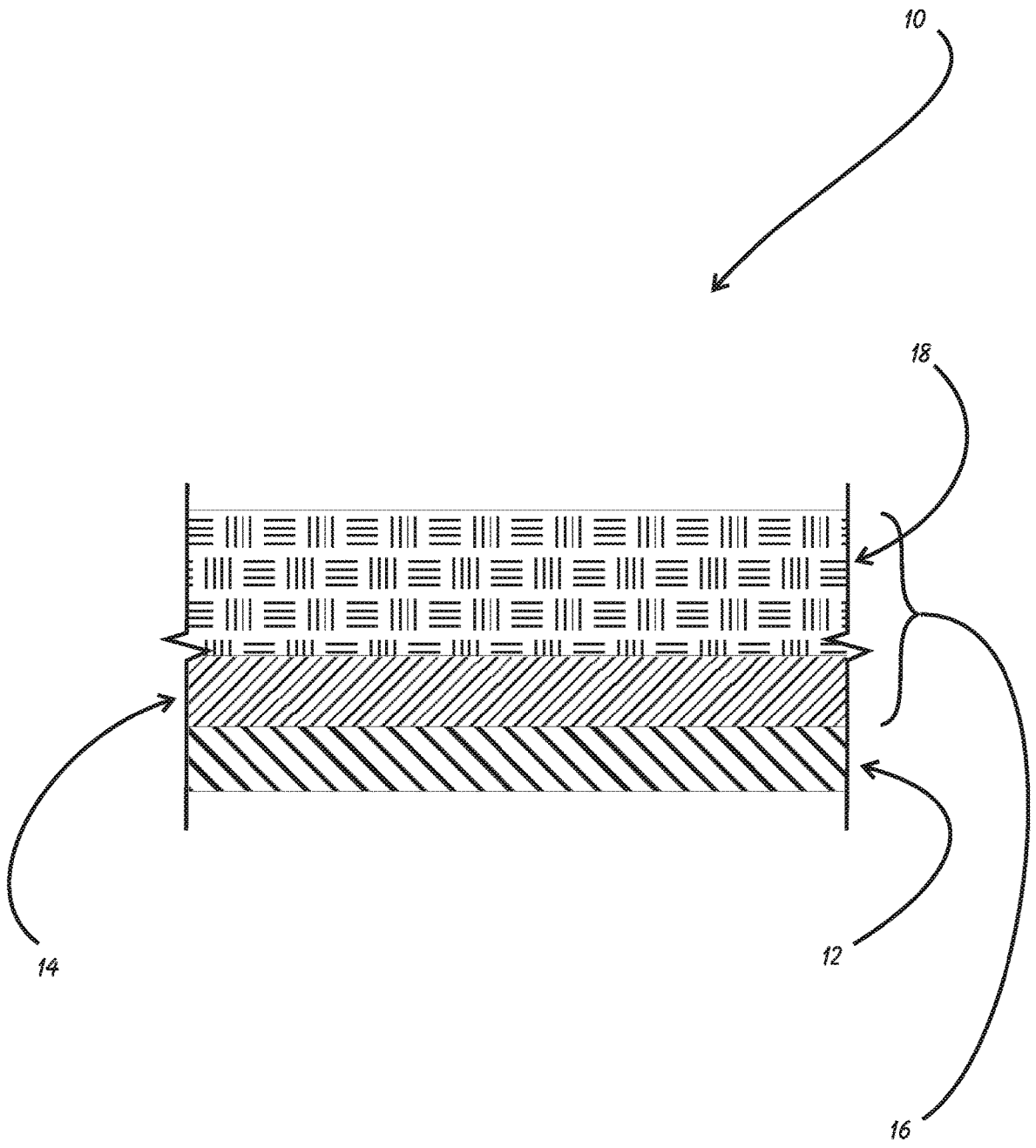
FIG. 1 is a cutaway side view of a preferred section of the sleeper of tomorrow of the present invention.

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide a Sleep Board Solution.

The invention is a unique comprehensive sleep system designed to reduce and eliminate lower back pain and significantly improve the quality of sleep time, providing a custom tailored system that is utilized on a pennanent basis for daily sleeping. Quality sleeping mattresses today typically cost over $1000 and can easily go up to $3000 and even more.

The present invention will cost less than $400 with far greater, healthier and longer lasting overall benefits.

The invention is composed of three elements. The first is a solid foundation capable of accepting the weight of an individual lying down with virtually no physical deflection of the foundation. For example, (but not limited to): a wood panel ½" to ¾" thick made of Baltic Birch sized approximately 24" wide by 60" long. A unique compact multi-layered foam support system providing full comfort and optimizing sleep efficiency on a permanent continuing day to day basis with no interruptions in the beneficial sleep cycles.

Depending upon an individual's specific needs or requirements, additional support features and adjustments can be made to the system to further optimize the benefits. The foundation or base of the invention serves as the key body alignment device for the lower back, hips, shoulders and neck with the unique layered foam system mounted/attached directly on top of the base to provide the long term comfort support needed for sleeping on a day to day uninterrupted basis. A removable and washable antimicrobial encasement is provided over both the base and the multi-layered foam.

Additional supportive elements are available with the system for specific individual needs or requirements. This system improves on previous methods and options for sleeping in the following ways: The degree of support of sleep mattresses on the market today varies from very soft to very firm and almost every support level in between, but none offer the level of a rigid no deflection foundation to keep the body properly aligned while sleeping, in addition to providing proper comfort for a long lasting healthy sleep eight hours per day on a permanent basis. Flexibility: The system is designed to be easily portable. It is compact (2"×24"×60") and light weight (<20 pounds). It can be used on top of any bed, couch, cot, or the floor. It can be can be stored as a spare bed for guests. It can be taken on family visits to relatives to guarantee quality sleep no matter what kind of bed or couch someone may wind up on, even on camping trips and vacations if the user wants to ensure that they have a good night's sleep.

Parts and Structure of invention (1.3.1): The invention is composed of three elements. A solid foundation capable of accepting the weight of an individual lying down with virtually no physical deflection of the foundation. For example (but not limited to): a wood panel ½" thick made of prefinished nine layer Baltic Birch 24"-28" by 60".

A multi-layered foam support system engineered to provide a mild constant traction system to the spine and back during sleep. Utilizing a unique proprietary manufacturing process which compresses, preloads and permanently sets the top most layer of the multilayered foam longitudinally during the bonding process. Stretching the back and spine to enhance blood flow to the vertebra between the discs and spine improving natural healing, proper back alignment and pressure reduction. The multi-layered foam is also designed to provide optimum long term comfort, optimize sleep efficiency and eliminate discomfort from "bottoming out" of hips, shoulders, elbows and knees against the solid support foundation.

The present invention can best be understood by initial consideration of FIG. 1.[1] FIG. 1 is a cutaway side view of a preferred section of the sleeper of tomorrow 10 of the present invention. The foundation 12 is a rigid panel, preferably made from birch or other wood or plywood. An uncompressed foam base layer 14 is glued to a compressed foam layer 18 via the method of the flowchart of FIG. 2 to form the foundation foam base 16. The foundation foam base 16 is encased within a cover and then attached to the foundation 12 via a series of hook-and-loop fasteners on the upper surface of the foundation, and the lower surface of the uncompressed foam base layer 14.

As used throughout this disclosure, element numbers enclosed in square brackets [ ] indicates that the referenced element is not shown in the instant drawing figure, but rather is displayed elsewhere in another drawing figure.

System is designed to an individual's specific requirements and issues to optimize quality of sleep, natural healing and energy restoration including the ESD carbon fiber encasement to provide the benefits of a natural Earthing/Grounding system.

The Foundation or Base of the invention serves as the key body alignment device for the lower back, hips, shoulders and neck to correct posture, eliminate back pain and resolve associated issues such as pinched nerves.

The proprietary multi-layered foam system is mounted/attached directly on top of the Foundation Base with 10 self-adhesive 1" diameter hook-and-loop fastener tabs to secure positioning and proper alignment of the foam to the base. The Proprietary Multi-layered foam provides sleeping comfort and continual traction to the spine and discs to increase blood flow and enhance healing during the sleeping cycle.

A removable (zippered) and washable antimicrobial encasement is slipped over the Foundation Base and Multi-Layered foam attached to one another (such as with hook-and-loop fasteners) like a pillow case and can be used as an Earthing/Grounding system for additional natural benefits.

Figure 2:
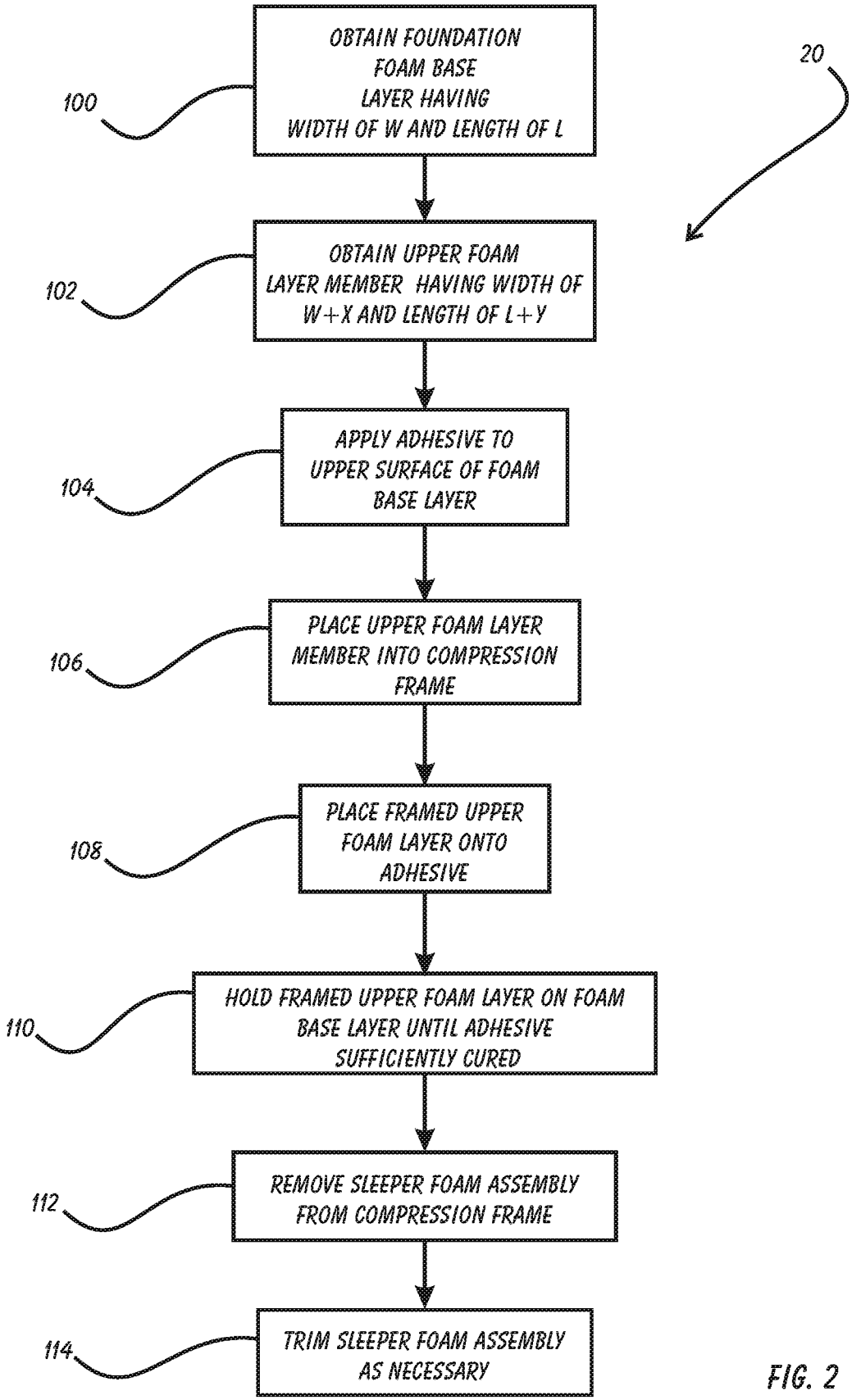
FIG. 2 is a flowchart depicting a preferred embodiment of the method of creating a sleeper assembly of the present invention.

FIG. 2 is a flowchart depicting a preferred method for creating the sleeper assembly [10]. First, a foundation foam base layer is obtained having a width of W and a length of L 100. Next, an upper foam layer member having a width of W+x and a length of L+y is obtained, where x any y can be greater than zero (or equal to zero if no compression is desired in either direction) 102. Adhesive is applied to the upper surface of the uncompressed foam base layer 104. The upper foam layer member is placed into the compression frame 106 such that it is compressed and until its width is W and its length is L. Steps 104 and 106 can be executed in any order, or simultaneously.

The framed upper foam layer is then placed atop the the foam base layer, such that the adhesive is between the layers [14, 18] 108. The framed upper foam layer until the adhesive is cured sufficiently 110.

Once the adhesive is cured, the now-completed foundation foam base [16] is removed from the compression frame 112. Finally, the sleeper foam assembly is trimmed as necessary so that it is the proper size 114.

Recapping the process steps:

Step 1: Bonding Adhesive is applied to top side of the Foundation Foam Base roll 5' wide and ½" thickness (length of roll is between 25' to 100' long)

Step 2: The Traction Top Layer foam 1" thickness is cut to a length of 66" and 29" wide and inserted into a specially designed Jig designed to compress the foam longitudinally 10% and hold the foam in place to be turned over and placed on top of the Foundation Foam with the Bonding Adhesive already applied to the top surface. Pressing and holding the two foam layers securely in place while the bonding adhesive to cures within approximately three minutes.

Step 3: The Foundation Foam is cut along the longitudinal edge(s) of the custom Jig from the roll and moved from the bonding adhesive production line for final processing.

Step 4: The bonded multi-layered foams bonded together are removed from the Custom Compression Jig and placed in a CNC machine for final trimming to the exact specifications and dimensions and ultimately final product assembly.

Figure 3:
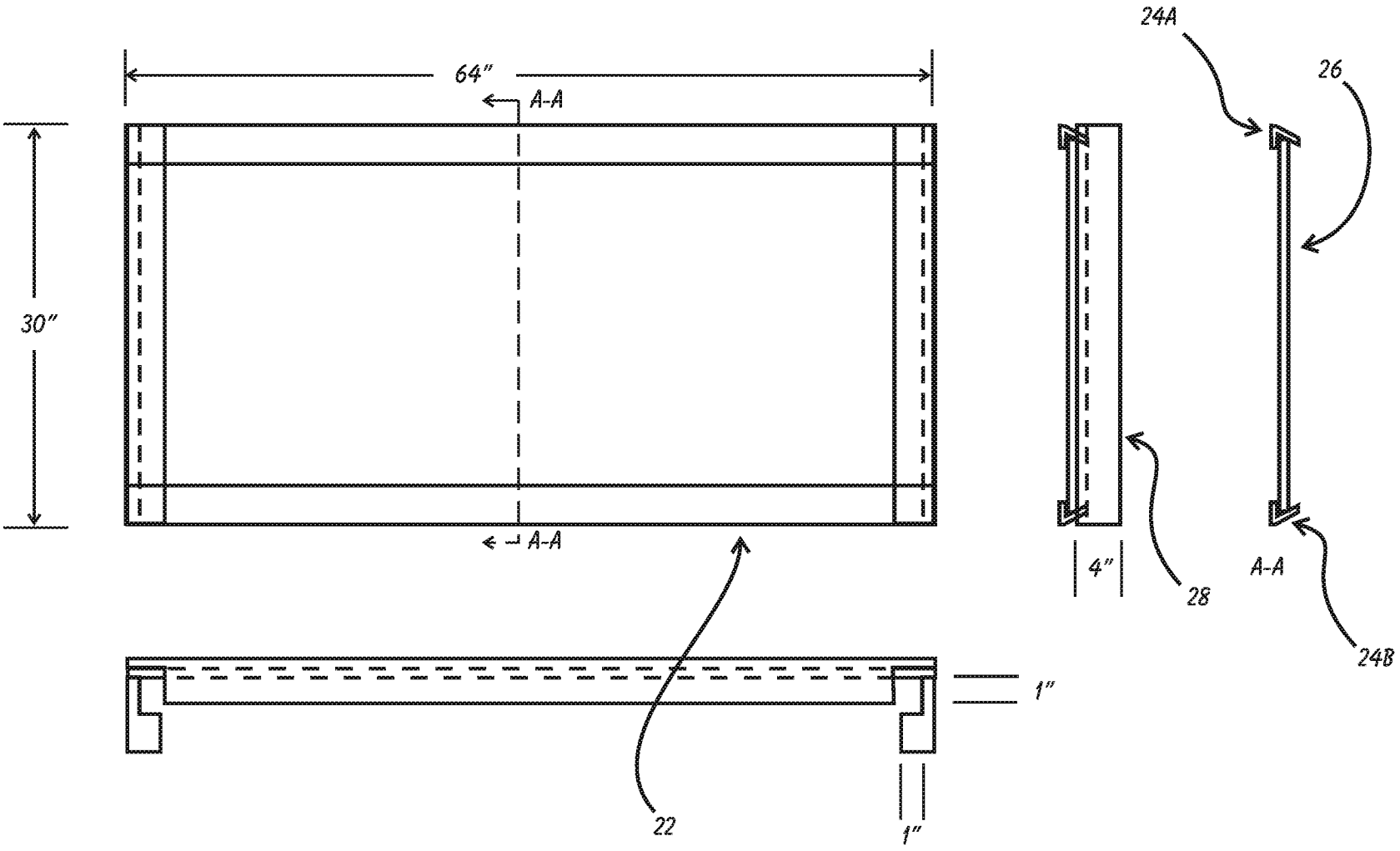
FIG. 3 is a preferred embodiment of the compression frame assembly used in the method of FIG. 2.

FIG. 3 depicts one preferred version of the compression frame assembly 22 (also referred to a compression jig assembly). In its preferred form, the assembly 22 will have a bottom panel 22 that is the length and width of the finished sleeper foundation foam base [16]. It has been shown that a low friction acrylic sheet (or coated element) is suitable as the bottom panel 26.

A pair of side rails 24A, 24B run the length of the bottom panel 26, and are preferably made from metal angle iron having an inwardly-turned 30 degree angle. At each end of the bottom panel 26 is an end block 28 preferably made of hardwood and notched as shown.

In the assembly 22 shown here, a piece of foam having a width of thirty (30) inches and a length of sixty-eight (68) inches is compressed by approximately 10% until its length is sixty-four (64) inches (prior to the adhering to the uncompressed foam layer).

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A sleeping device assembly, comprising:

a foundation comprising a rigid panel;

a foundation foam base comprising an uncompressed first foam layer and a compressed second foam layer, wherein the first foam layer is bonded with adhesive to the second foam layer, and wherein the second foam layer is compressed by 5.9%-10% along a longitudinal dimension prior to being bonded to the first foam layer such that said second foam layer is configured to exert a longitudinally continuous outward biasing force on the first foam layer;

hook and loop fasteners provided between said rigid panel and said first foam layer, wherein the hook and loop fasteners releasably attach the rigid panel to the foundation foam base;

an encasement having a width and a length, constructed of a fabric material;

a zipper along the width of the encasement, wherein the encasement material includes carbon fiber conductive strips woven into the fabric thereby providing electrical grounding to reduce static shocks; wherein the encasement is removable and machine washable.

2. The assembly of claim 1, wherein said second foam layer is compressed longitudinally to a length of L and compressed laterally to a width of W prior to its permanent attachment to said first foam layer.

3. The assembly of claim 2, wherein prior to being attached to one another:

said first foam layer defines a width of W and length of L; and said second foam layer defines a length longitudinally of L plus Y, wherein Y is greater than zero up to 6 inches.

4. The assembly of claim 3, wherein prior to being attached to one another, said second layer defines a width laterally of W plus X, wherein X is greater than zero up to 2 inches.

5. The assembly of claim 1 wherein the rigid panel, the first foam layer, and the second foam layer are capable of being placed inside of the encasement and the zipper on the encasement is capable of being fastened dosed with the rigid panel, the first foam layer, and the second foam layer being inside of the encasement.

* * * * *